United States Patent [19]

Lazcano-Navarro et al.

[11] Patent Number: 4,596,382

[45] Date of Patent: Jun. 24, 1986

[54] TELESCOPIC SEALING HOOD BETWEEN CONVERTER AND STACK WHILE REFINING IRON

[75] Inventors: Arturo Lazcano-Navarro; Antonio Villaseñor-Mejía, both of Saltillo, Mexico

[73] Assignee: Instituto Mexicano de Investigaciones, Saltillo, Mexico

[21] Appl. No.: 642,255

[22] Filed: Aug. 20, 1984

[30] Foreign Application Priority Data

May 9, 1984 [MX] Mexico ..... 201282

[51] Int. Cl.[4] ..... C21C 5/38

[52] U.S. Cl. ..... 266/158; 266/287; 266/159

[58] Field of Search ..... 266/144, 145, 184, 158, 266/159, 287

[56] References Cited

U.S. PATENT DOCUMENTS

| | | | |
|---|---|---|---|
| 3,045,996 | 7/1962 | Rice | 266/159 |
| 3,205,810 | 9/1965 | Rosenak | 266/158 |
| 3,797,812 | 3/1974 | Ivessa | 266/158 |

FOREIGN PATENT DOCUMENTS

| | | | |
|---|---|---|---|
| M 21009 | 3/1956 | Fed. Rep. of Germany | 266/158 |
| 0085813 | 5/1984 | Japan | 266/158 |

*Primary Examiner*—Melvyn J. Andrews
*Assistant Examiner*—Robert L. McDowell
*Attorney, Agent, or Firm*—Laurence R. Brown

[57] ABSTRACT

A telescopic hood seals the coupling between the top of an oxygen converter and the stack during the melting and refining of iron in the converter.

2 Claims, 2 Drawing Figures

TELESCOPIC SEALING HOOD BETWEEN CONVERTER AND STACK WHILE REFINING IRON

BACKGROUND OF THE INVENTION

This invention is related specifically to the air tight sealing of the coupling joint between the top of the converter and the stack while melting and refining iron. Usually this refining requires control of contamination, that is to say, the objective is to cool and clean powder from the gases generated during the refining process in the converter. In general the stack is located as close as possible to the top of the converter without regard to admission of atmospheric air. Nevertheless, air seal at the joint must be concerned about the volume of gases handled in the stack and the temperature changes affected by the combustion of air coming in the stack, and in leakage of the carbon monoxide generated in the converter.

SUMMARY OF THE INVENTION

In the present invention, a telescopic hood stack extension can go up and down. Its operation makes possible the control of the coupling between the top of the converter and the stack and thus the air admitted as a function of this coupling. An added height control with pressure sensors will adjust for the minimum amount of air in order to be able to utilize the gas generated in the converter in some other processes. However, the device still could accept air due improper sealing of the movable hood contact surfaces and still could leak out products from molten metal inside the converter.

It is then an object of the present invention to maintain a minimum (almost zero) air inlet to the stack, to permit use of the gas that flows inside of said stack for purposes known in the art.

It is also another object of the invention to increase the safety of this stack coupling joint avoiding any malfunction of operation that could lead to a massive volumne inlet of air which could be dangerous to the users of the stack gas and to the equipment in which it is used.

DESCRIPTION OF THE INVENTION

Figure 1:
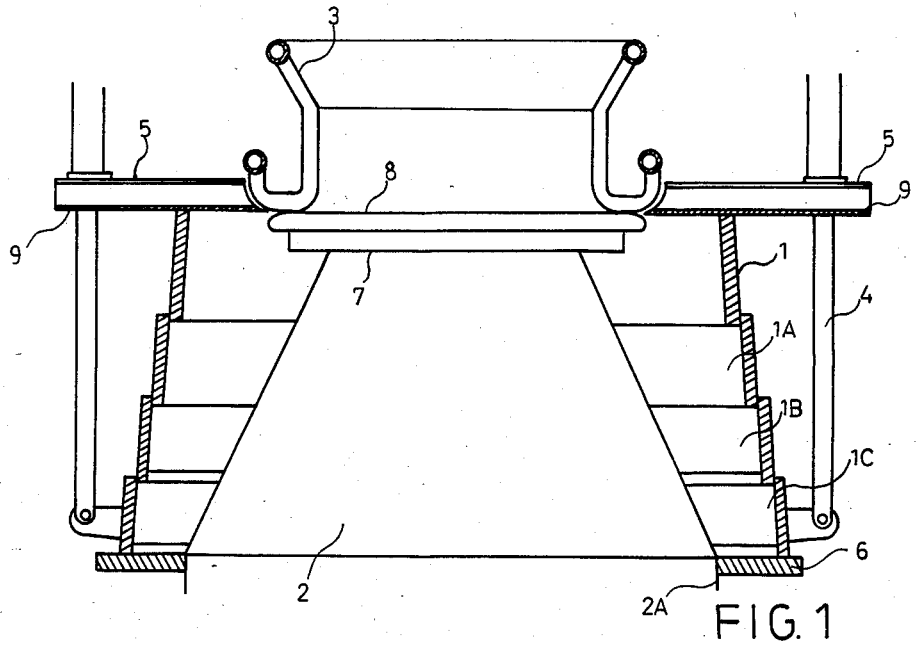
FIG. 1 shows a vertical view partly in cross section of the stack and converter coupling surrounded by a telescopic hood.
Figure 2:
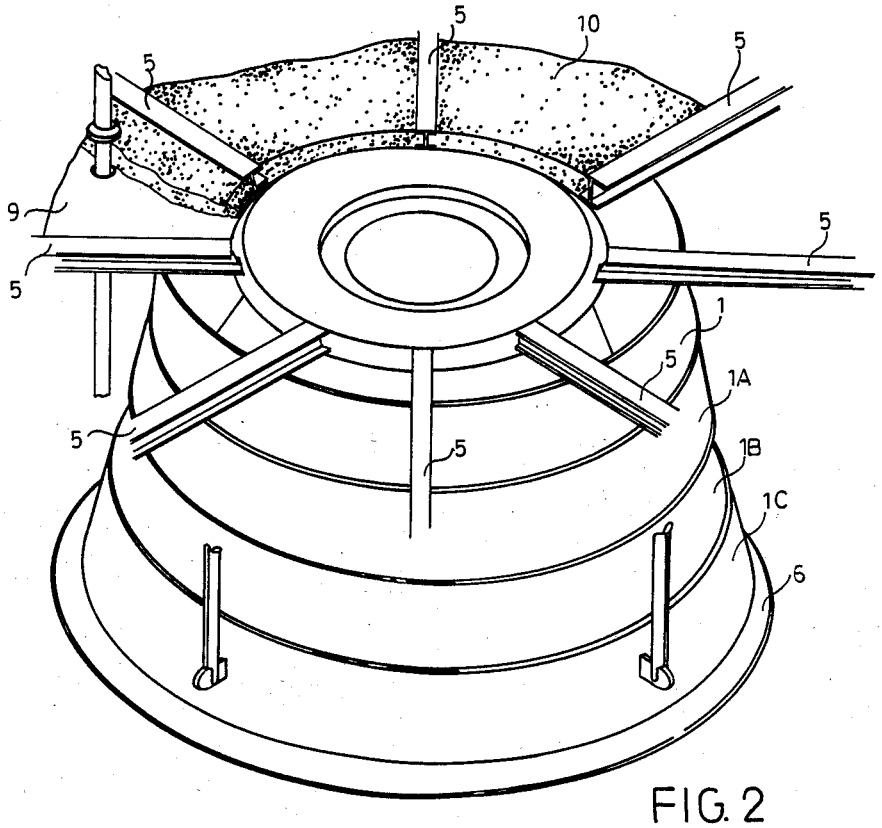
FIG. 2 shows a perspective view partly broken away of the hood stack and converter.

Referring to the drawings, the conic sections (1, 1A, 1B, 1C) of the system form a frustum conic telescopic hood. The hood is a stack extension, which abuts in the upper part a plurality of steel members (5), disposed radially and equidistant as joined together by a plate 9 covered with refractory (10). The lower section (6) is joined to pneumatic pistons (4). When the pistons (4) are in a contracted position all the frustum conic telescopic hood sections collapse against the members (5). In extended position, pneumatic pressure seals the joint between the lower conic section (1C) with its circular rim (6) located about the upper part (2A) of the converter (2). The telescopic hood may go up with the stack skirt (3) to allow the tilting of said converter. The skirt (3) and the frustum—conic telescopic hood are joined to avoid any air inlet, such as due to irregularity of the top (7) of the converter (2) and the lower part of the stack skirt (8). The concic hood (1, 1A, 1B, 1C) may vary according to the needs of the dimensions of the skirt (3) and the converter (2).

We claim:

1. A sealing apparatus for sealing the space between a stack 3 and a converter 2 to prevent leakage out of unwanted gases and insertion of air into the stack, comprising in combination an upper plate member 9 positioned to sealingly engage the bottom of the stack 3, an annular circular rim plate 6 sealingly engaging the side wall of a converter 2, a segmental frustoconical hood nested with the larger diameter of each segment 1A, 1B, 1C directed downwardly so that each segment as it is lowered seals against the bottom of the immediately above segment under gravity to produce a gas tight compartment about the skirt to engage the converter 2 in a substantially air tight seal for preventing gas flow into or out of the stack 3 and the smaller diameter of the upper most segment being secured to said upper plate member 9 and the larger diameter of the bottom most segment of said hood being secured to said annular circular rim plate 6 which engages the converter sidewalls below the mouth of said converter 2, and piston means connected with the rim plate 6 of said segmental conical hood to telescope said hood selectively between the stack and converter.

2. A system defined in claim 1 wherein the stack communicates with the converter by an aperture in a plate covered with refractory and the outer hood sections are coupled between the plate and the converter.

* * * * *